United States Patent [19]

Creaden

[11] Patent Number: 5,016,751

[45] Date of Patent: May 21, 1991

[54] MOLDED FLOURESCENT TUBE DUNNAGE ELEMENT

[75] Inventor: David E. Creaden, Lawrence, Kans.

[73] Assignee: Lawrence Paper Company, Lawrence, Kans.

[21] Appl. No.: 568,014

[22] Filed: Aug. 16, 1990

[51] Int. Cl.[5] ..... B65D 85/42

[52] U.S. Cl. ..... 206/419; 206/519; 206/587; 217/35

[58] Field of Search ..... 206/418–422, 206/443, 518, 519, 585, 587, 591–594; 217/26.5, 27, 35; 220/23.6, 23.8

[56] References Cited

U.S. PATENT DOCUMENTS

| | | | |
|---|---|---|---|
| 3,223,234 | 12/1965 | Weiss | 206/419 |
| 3,708,084 | 1/1973 | Bixler | 206/419 |
| 4,427,730 | 1/1984 | Robbins et al. | 206/419 |
| 4,705,170 | 11/1987 | Creaden | 206/419 |
| 4,792,045 | 12/1988 | Creaden | 206/419 |
| 4,936,453 | 6/1990 | Knitter | 206/587 |
| 4,942,965 | 7/1990 | Comer | 206/419 |

*Primary Examiner*—Jimmy G. Foster

*Attorney, Agent, or Firm*—Hovey, Williams, Timmons & Collins

[57] ABSTRACT

Fluorescent tube-supporting dunnage elements (10) are provided which are designed to ensure easy machine-dispensibility thereof by preventing complete nesting of a stack of interfitted supports (10). The supports (10) are integral, thermo-formed bodies presently a plurality of elongated, open-top, juxtaposed tube-receiving recesses (24) each presenting alternating, upwardly and downwardly opening and diverging wall sections (52,54) interconnected by short upright walls (56). The walls (56) are provided with outwardly extending, upwardly opening arcuate ridges (58) which prevent complete nesting of stacked supports (10).

3 Claims, 2 Drawing Sheets

MOLDED FLOURESCENT TUBE DUNNAGE ELEMENT

BACKGROUND OF THE INVENTION

1. Field of the Invention

The present invention is broadly concerned with an improved synthetic resin fluorescent tube support of the type used in the packaging and shipping of an elongated fluorescent tubes in order to prevent breakage thereof. More particularly, it is concerned with such a fluorescent tube support which is improved by provision of specific structural features permitting the supports to be stacked without complete nesting thereof, so as to facilitate machine dispensing of the dunnage elements during the packaging process. At the same time, the dunnage elements hereof give excellent protection against breakage of the tubes.

2. Description of the Prior Art

U.S. Pat. Nos. 4,705,170 and 4,792,045 describe synthetic resin tube dunnage supports formed of integral, synthetic resin sheet material and which are designed to supplant traditional supports manufactured from pulp or the like. A prime advantage of the supports described in the aforementioned patents stems from the fact that they are machined dispensable i.e., they overcome the problems heretofore associated with the attempts at machine dispensing fluorescent tubes supports, and thereby lower manufacturing and packaging costs.

Certain prior dunnage supports have made use of a rather complicated system of lugs formed in the bodies of the supports so as to facilitate stacking of the supports without complete nesting. Such lug systems generally require that the molds made for respective supports be different so as to minimize the possibility of stacking together of the identically configured supports. The need to provide unique molds can increase manufacturing costs, and generally complicates the fabrication and stacking process.

It would therefore be desirable to provide synthetic resin dunnage elements with appropriate structural features assuring that the supports may be stacked without nesting or interfitting thereof to a degree which would cause hang-up or other problems during machine dispensing, while at the same time avoiding the necessity for a series of unique molds.

SUMMARY OF THE INVENTION

The present invention overcomes the problems noted above, and provides a dunnage support having specific constructural features for proper stacking and ultimate machine dispensing of the molded supports.

Broadly speaking, the supports in accordance with the invention are in the form integral synthetic resin bodies presenting concavo-convex walls defining a number of elongated, open-top, juxtaposed concave tube-receiving regions, with an elongated, axially extending top walls between such adjacent tube-receiving regions. The preferred supports include, along the length of the respective tube-receiving regions, a first plurality of axially spaced apart, upwardly opening and diverging tube-engaging wall sections, together with a second plurality of axially spaced apart, downwardly opening and diverging tube engaging arcuate second wall sections which alternate with the first wall sections. Upstanding walls are provided between and interconnecting relationship with the alternating first and second wall sections.

In the specific improvement of the invention, the upstanding, interconnecting walls described previously are provided with outwardly extending, arcuate ridges thereon for preventing complete nesting of a pair of supports when stacked together. This feature, together with a ledge provided in the upstanding front wall of the support, cooperatively prevent full nesting together of stacked supports.

In preferred forms, the arcuate ridges have an upwardly opening curvature, are generally parallel with the curvature of the upwardly opening first wall sections, and are spaced below the circumscribing lip of the support.

U.S. Pat. Nos. 4,705,170 and 4,792,045 are incorporated by reference herein, along with a pending application for U.S. patent Ser. Nos. 07/396,562, filed Aug. 21, 1989, and 07/568,754, filed Aug. 17, 1990, in the name of David E. Creaden and entitled "Minimum Length Fluorescent Tube Dunnage Element."

DESCRIPTION OF THE PREFERRED EMBODIMENT

Figures 1, 2, 3:
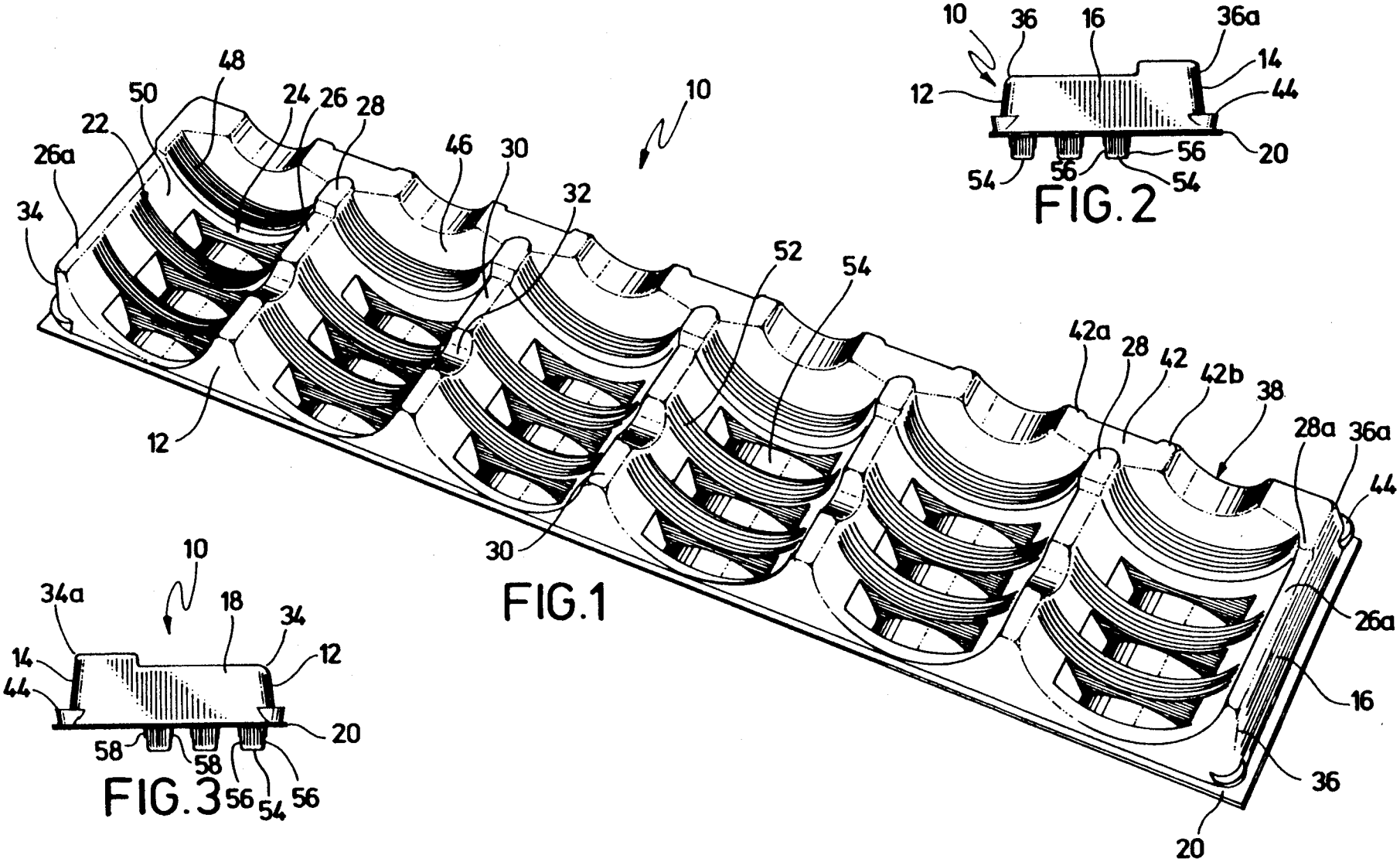
FIG. 1 is a perspective view of a synthetic resin dunnage element in accordance with the invention.
FIG. 2 is an end elevational view thereof.
FIG. 3 is an end elevational view thereof opposite that depicted in FIG. 2.

Turning now to the drawings, a tube support 10 is depicted. The support 10 is in the form of an integral, synthetic resin, thermo-formed body presenting a rear wall 12, front wall 14, and interconnecting end walls 16, 18. The walls 12–18 include, at the lower most extents thereof, a common, circumscribing, short, laterally extending peripheral lip 20.

The overall support 10 is further provided the total of six concavo-convexed wall sections 22 which cooperatively present a plurality of individual, elongated, open-top, parallel, juxtaposed, concave, fluorescent tube-receiving sockets or regions 24. It will be noted that the regions 24 terminate at rear wall 12, and accordingly the latter presents an overall configuration a scalloped appearance. The wall sections 22 are joined at their respective apices by means of elongated, fore-and aft-extending connector walls 26 and endmost connector walls **26*a*. The walls 26 include uppermost pad sections 28 adjacent front wall 14, as well as a rearwardly extending, generally planar portion 30 which is interrupted at substantially the center thereof by an arcuate depression 32. The connector walls 26*a* on the other hand include an uppermost pad section 28*a***.

Figures 4, 5, 6, 7:
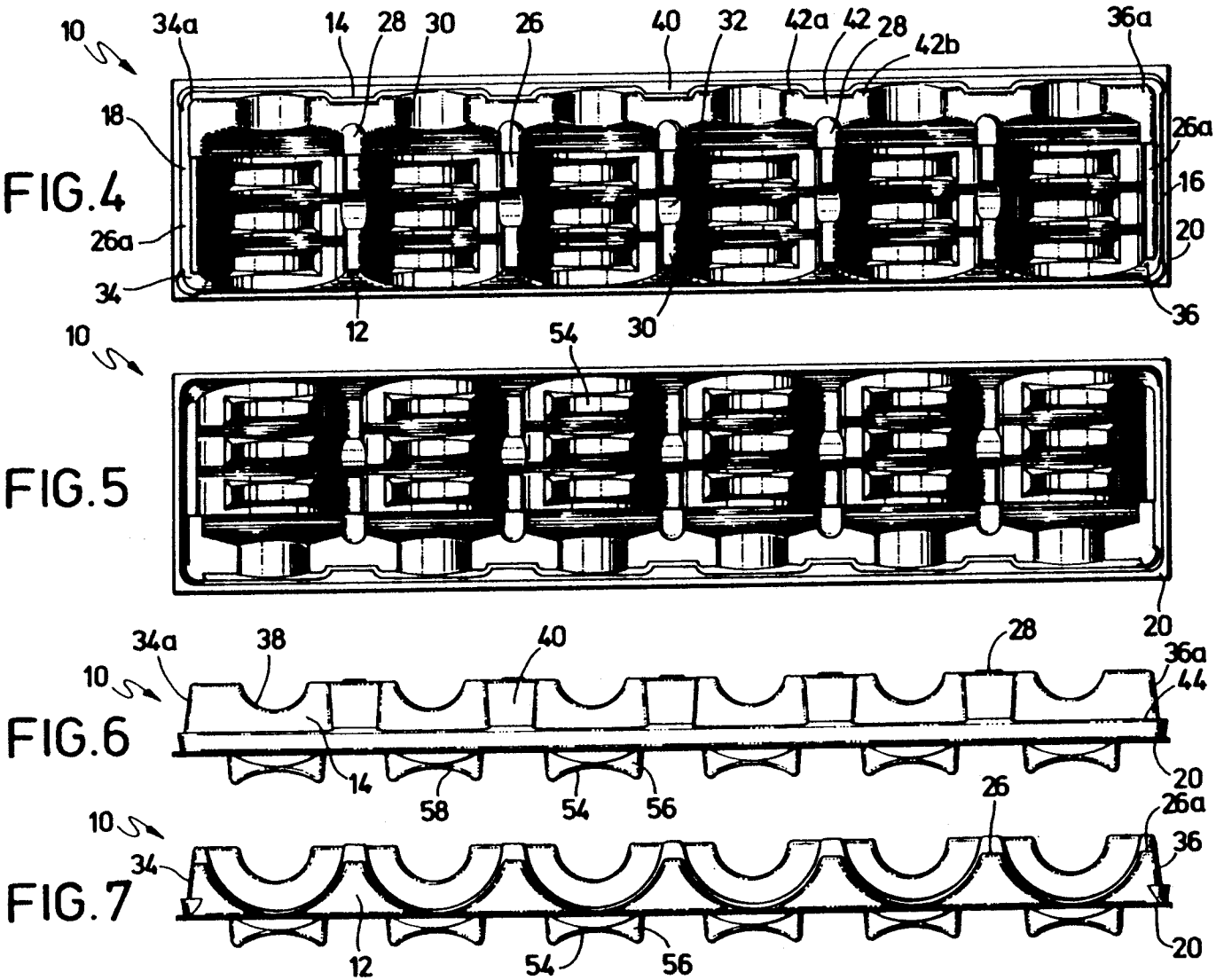
FIG. 4 is a plan view thereof.
FIG. 5 is a bottom view thereof.
FIG. 6 is a front elevational view thereof.
FIG. 7 is a rear elevational view thereof.

Rear wall 12 is an upstanding member which is slightly inclined as best viewed in FIGS. 1 and 4. The rear wall 12 merges with end walls 16, 18 at rounded corners 34, 36.

Front wall 14 is an upright member having a total of six laterally spaced apart, generally arcuate pin-receiving recesses 38 formed therein, with each of the latter being in alignment and in communication with a corresponding, rearwardly extending tube-receiving region 24. In addition, the face of front wall 14 is provided with a total of six generally trapezoidal, upwardly opening indentations 40 which are oriented in alternating relationship with the recesses 38 (see FIG. 6). Each indentation 40 is partially defined by somewhat Y-shaped wall section 42 formed by a pair of bifurcations 42*a*, 42*b* and the associated pad section 28 of the rearwardly extending connector wall 26. The front wall 14 is merged into end walls 16, 18 at rounded corners 34*a*, 36*b*. Finally, it will be observed that the rear wall 14 is provided with an elongated ridge 44 along the entire length thereof which is diposed below the recesses 38 and in effect defines the lowermost ends of the respective indentations 40.

The end walls 16, 18 are essentially identical and each is a substantially planar, upright member terminating at the associated endmost connector wall 26*a*.

Each of the tube-receiving regions 24 is defined by an upstanding, somewhat inclined and tapered inner wall portion 46 which is generally parallel with front wall 14, as well as arcuate, diverging, upwardly opening wall segment 48 adapted to receive and support the metallic end cap of a fluorescent tube. The portion of the concavo-convex wall portion 22 extending rearwardly from segment 48 includes, for each region 24, a major wall 50 of arcuate, upwardly opening and diverging configuration adapted to receive the arcuate side wall of a fluorescent tube. In each instance the major wall 50 merges into a corresponding pair of uppermost connector walls arranged on either side of each recess 24.

The major wall 50 further includes a first plurality (here two) of upwardly opening and diverging first wall sections 52 which are formed to generally to conform with the curvature of a fluorescent tube, together with a second plurality of downwardly opening and diverging and arcuate second wall sections 54 which are likewise configured to engage the side wall of a fluorescent tube. As best seen in FIG. 1, the walls 52, 54 alternate along the length of major wall portion 50, with the first wall section 52 (and the segments 48) being formed to present series of ribs or ridges in the faces thereof. Finally, it will be seen that the alternating wall section 52, 54 are interconnected by means of upstanding walls 56.

In order to provide the desirable stacking feature of the present invention, each of the upstanding connector walls 56 is provided with an outwardly extending, arcuate ridge 58 thereon. Each ridge 58 is advantageously below peripheral lip 20, and is of upwardly opening curvature essentially complemental and parallel with the curvature of the upwardly opening wall sections 52. These ridges 58, together with the aforementioned ridge 44 provided in front wall 14, cooperatively provide the desirable stacking function for the supports of the invention. That is to say, the disclosed structure prevents a pair of interfitted supports from complete nesting so as to leave at least an $\frac{1}{8}$ inch (and preferably from about $\frac{1}{8}$ to $\frac{3}{8}$ inch) spacing between each individual support in a stack thereof. In this fashion, automated dispensing equipment can readily separate respective supports 10 without fear of machine foul ups.

The elements 10 may be formed of a wide variety of synthetic resin materials such as polyvinychlorides, polyesters or polyethylene terpthalates. In the most preferred forms, however, the supports are formed from PVC material having a thickness of about 0.009–0.018 inches, or preferably about 0.013–0.018 inches, and most preferably about 0.013–0.014. In addition, while a variety of molding techniques can be employed, it is presently preferred to make use of the female mold for forming the supports 10, without a closely fitted uncooled plug assist.

I claim:

1. In a fluorescent tube support formed of synthetic resin material and presenting an integral body having concavo-convex walls defining a number of elongated, open-top, parallel, juxtaposed, concave tube-receiving regions, said region-defining walls including a first plurality of axially spaced apart, upwardly opening and diverging tube-engaging arcuate first wall sections, a second plurality of axially spaced apart, downwardly opening and diverging tube-engaging arcuate wall sections alternating with said first wall sections, and connecting walls extending between and interconnecting said alternating first and second walls, the improvement which comprises at least certain of said connecting walls each including outwardly extending, arcuate ridges thereon for preventing complete nesting of a pair of said supports when stacked together.

2. The tube support of claim 1, said ridge having an upwardly opening curvature.

3. The tube support of claim 2, said ridges having a curvature generally parallel with the curvature of said first wall sections.

* * * * *